US006957523B2

(12) United States Patent
Siccardi

(10) Patent No.: US 6,957,523 B2
(45) Date of Patent: Oct. 25, 2005

(54) SYSTEM TO FORM, FILL AND SEAL FLEXIBLE BAGS

(75) Inventor: Alberto Siccardi, Villa Luganese Canton Ticino (CH)

(73) Assignee: Baxter International Inc., Deerfield, IL (US)

( * ) Notice: Subject to any disclaimer, the term of this patent is extended or adjusted under 35 U.S.C. 154(b) by 0 days.

(21) Appl. No.: 10/087,563

(22) Filed: Feb. 28, 2002

(65) Prior Publication Data

US 2002/0088201 A1 Jul. 11, 2002

Related U.S. Application Data

(63) Continuation of application No. 09/316,165, filed on May 21, 1999, which is a continuation of application No. PCT/IB97/01458, filed on Nov. 18, 1997.

(30) Foreign Application Priority Data

Nov. 22, 1996 (IT) ..... MI96A2451

(51) Int. Cl.[7] ..... B65B 61/00

(52) U.S. Cl. ..... 53/425; 53/451; 53/551; 53/410; 53/133.1; 53/133.2; 53/76; 53/167; 422/82.01

(58) Field of Search ..... 53/425, 426, 551, 53/550, 410, 411, 167, 33.1, 33.2, 451, 75, 76; 493/5, 17, 210, 921; 422/82.01, 82.02

(56) References Cited

U.S. PATENT DOCUMENTS

| | | | | | |
|---|---|---|---|---|---|
| 1,951,035 | A | * | 3/1934 | Parker | 23/253 |
| 2,289,610 | A | * | 7/1942 | Wallace | 210/28 |
| 3,451,403 | A | * | 6/1969 | Madsen | 137/5 |
| 3,683,757 | A | * | 8/1972 | Lenk | 93/61 AC |
| 4,326,574 | A | | 4/1982 | Pallaroni et al. | |
| 4,396,582 | A | * | 8/1983 | Kodera | 422/300 |
| 4,467,003 | A | | 8/1984 | Pallaroni et al. | |
| 4,587,793 | A | * | 5/1986 | Brennan et al. | 53/425 |
| 4,656,813 | A | * | 4/1987 | Baldini et al. | 53/410 |
| 4,731,980 | A | * | 3/1988 | Worden et al. | 53/551 |
| 4,732,299 | A | | 3/1988 | Hoyt | |
| 4,887,913 | A | | 12/1989 | Sengewald | |
| 5,069,017 | A | * | 12/1991 | Fabricius | 53/426 |
| 5,129,212 | A | * | 7/1992 | Duffey et al. | 53/426 |
| 5,174,096 | A | | 12/1992 | Fukuda | |
| 5,473,857 | A | * | 12/1995 | Keeler | 53/410 |
| 5,606,844 | A | * | 3/1997 | Takagaki et al. | 53/410 |
| 5,653,428 | A | * | 8/1997 | Dufour et al. | 270/6 |
| 5,934,043 | A | * | 8/1999 | Aindow et al. | |
| 5,976,299 | A | * | 11/1999 | Ivey | 156/270 |

FOREIGN PATENT DOCUMENTS

| | | | |
|---|---|---|---|
| DE | 197 52 648 C1 | | 3/1999 |
| EP | 0 067 420 A1 | | 12/1982 |
| EP | 0 142 758 A | | 5/1985 |
| EP | 0 618 136 A | | 10/1994 |
| EP | 0 658 421 A1 | | 6/1995 |
| FR | 2 444 619 A | | 7/1980 |
| GB | 830 859 A | | 3/1960 |
| GB | 2142282 | * | 1/1985 |
| WO | WO 95/16565 | | 6/1995 |

* cited by examiner

*Primary Examiner*—John Sipos
*Assistant Examiner*—Christopher Harmon
(74) *Attorney, Agent, or Firm*—Paula J. F. Kelly; Joseph F. Reagen; Bell, Boyd & Lloyd LLC

(57) ABSTRACT

A system to form, fill and seal (FFS) flexible bags including the steps of: a total printing of the film as it winds off the supply reel; a dry cleaning; a gimballed aligning for the folding of the printed and washed film; a hot-bar welding of the folded film; a valve welding controlled by an algorithm; a humidification treatment of the valve cavity; a shaping of the bags by hot tools also controlled by an algorithm; and a high precision dosage of the filling liquid.

23 Claims, 8 Drawing Sheets

SYSTEM TO FORM, FILL AND SEAL FLEXIBLE BAGS

RELATED APPLICATIONS

This Application is a continuation of application Ser. No. 09/316,165 filed May 21, 1999 which is a continuation of International Application No. PCT/IB97/01458, filed Nov. 18, 1997. U.S. Ser. No. 09/316,165 and International Application No. PCT/IB97/01458 are herely incorporated herein by reference, and made a part hereof.

TECHNICAL FIELD

The present invention concerns a system to form, fill and seal (F.F.S.) containers of flexible plastic materials, in particular sterilizable bags containing solutions for the administration of infusion solutions.

BACKGROUND OF THE INVENTION

Numerous prior art systems for manufacturing flexible containers, or bags, for use with infusion solutions in the medical field are known. For example, U.S. Pat. No. 4,656,813, describes a system for industrial production of these types of bags. These bags are sometimes generally referred to as form, fill and seal (F.F.S.) containers. These bags typically have a laminated construction and include a valve to accommodate various connectors of an infusion apparatus, such as a luer-type valve. The bags are typically sterilized during or after the manufacturing process. Sterilization of a bag that incorporates various design features, such as valves, can be difficult. The manufacturing and sterilizing process becomes even more difficult with present day bags that may be required to have additional features, such as means for bag suspension, complex valves, or twin-valve systems. These features create areas of the bag that are difficult to access by a sterilization solution during the sterilization process. This can cause variation in the sterilization times of these areas, which in turn can cause incomplete or ineffective sterilization. This variation can also have an effect on the proper selection of sterilization solution dosages.

Therefore, it is an object of the present invention to provide a system and associated method for manufacturing F.F.S. containers of flexible plastic materials that can be easily sterilized without the disadvantages of previous systems and methods.

It is also an object of the present invention to provide a system and method for manufacturing F.F.S. containers of flexible plastic materials that are characterized by high manufacturing efficiency, sterilization reliability, and precision.

It is a further object of the present invention to provide a less expensive and space-efficient system for manufacturing F.F.S. containers of flexible plastic materials.

These and other objects will become readily apparent after review of the specification, drawings, and accompanying claims.

SUMMARY OF THE INVENTION

The system of the present invention includes a method of manufacturing form, fill and seal (F.F.S.) containers, or bags, made from flexible plastic materials. The system and associated method generally include the steps of: (1) feeding from at least one reel a plastic and flexible material in the form of a film or pellicle, preferably multilayer, for forming the bag; (2) printing the material pulled from the reel; (3) winding the printed material; (4) washing the printed material; (5) aligning and folding the printed and washed film; (6) welding the folded film in a first direction; (7) feeding and applying valves on the surface of the folded and welded film; (8) making a second welding in a second direction; and, (9) cooling and cutting the bags to send to them for overwrapping and sterilizing.

DETAIL DESCRIPTION OF THE PREFERRED EMBODIMENTS

Figure 1:
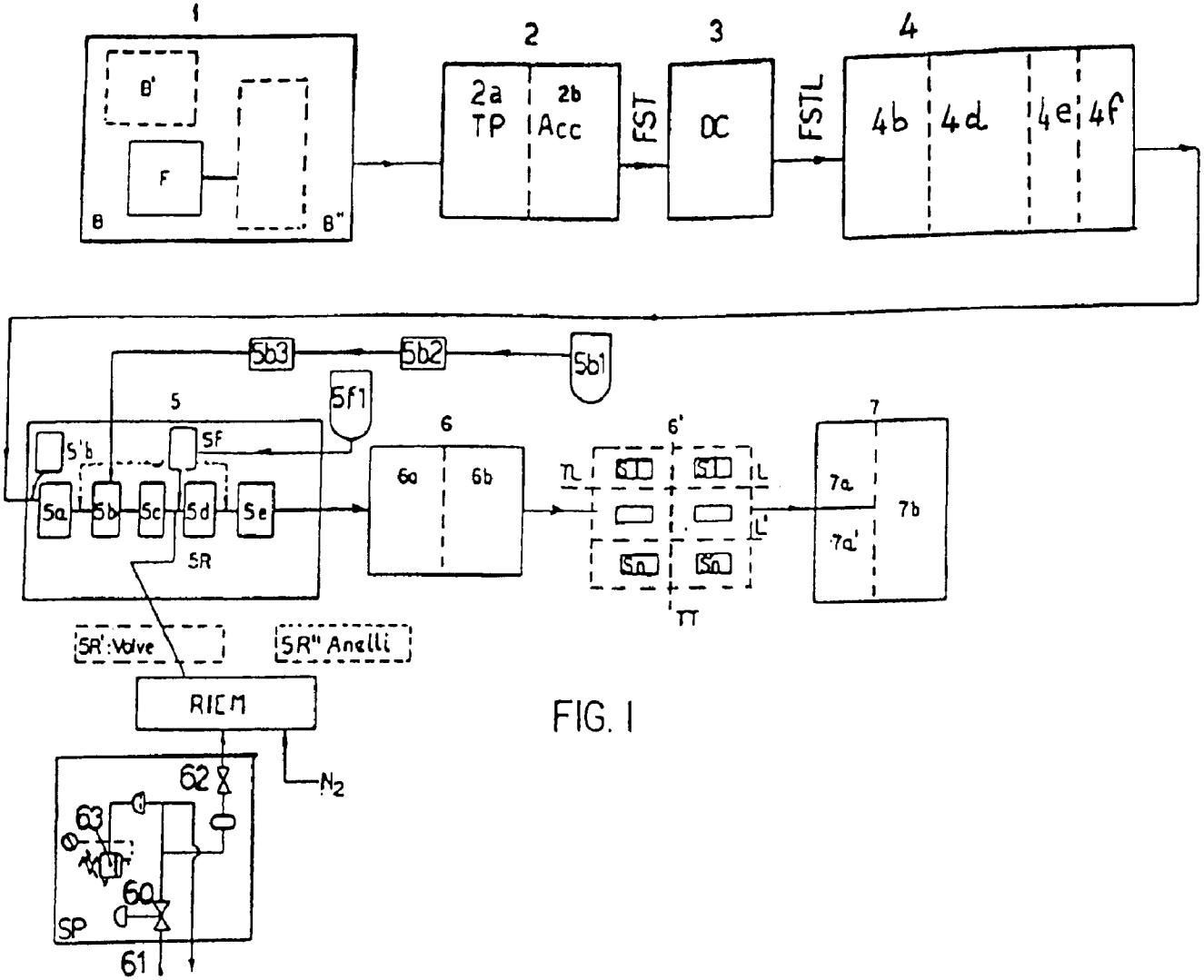
FIG. 1 is a block diagram of the system of the present invention.
Figures 2, 2A:
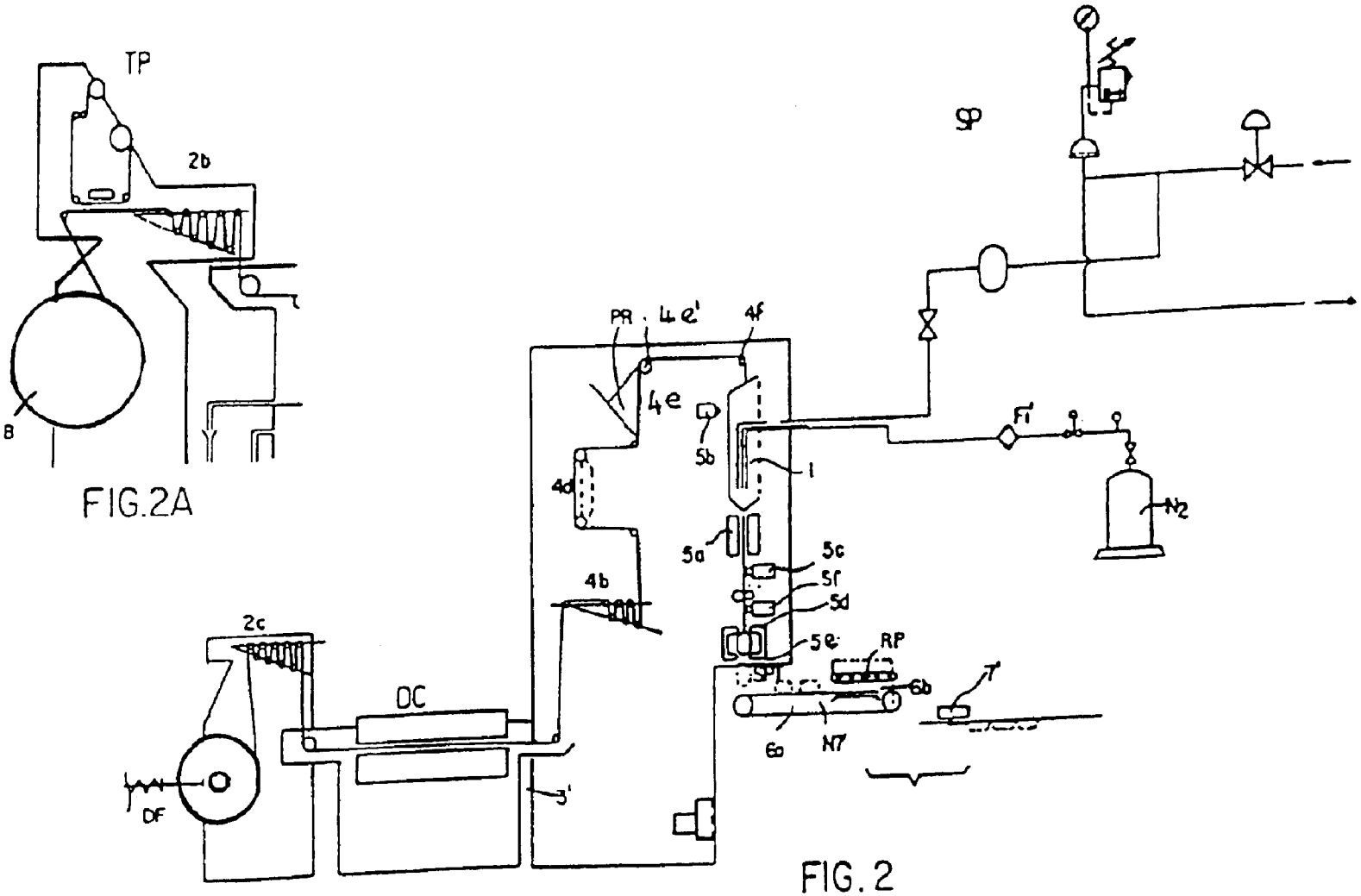
FIG. 2 is a schematic diagram of an embodiment of the system of FIG. 1.
FIG. 2A is a partial view of a variation of the embodiment disclosed in FIG. 2.

The system of the present invention is represented in FIGS. 1 and 2. The system comprises at least five stations, each involving one or more steps of the method of the present invention.

Referring to FIG. 1, block 1 represents the supplying station that feeds a film F from a first reel B. The dashed line rectangles B' and B" represent optional reel configurations. The reel B' can be placed in addition to and parallel to the first reel B. The reel B' is preferably of the same width as the first reel B. Alternatively, the reel B" can be used in lieu of reels B or B'. In this case, the reel B" is preferably n times the width of B or B'. Referring to FIG. 2, a tension adjustment and braking mechanism DF is provided in communication with the reels B and/or B', or B".

Block 2 of FIG. 1 represents a total printing (TP) station 2*a* that is followed by an accumulation station 2*b*. The TP station 2*a* provides in-line printing of the film. The accumulation station 2*b* accumulates the printed film in-line with the TP station 2*a*. The TP station 2*a* includes a hot printer that utilizes a hot press and a pigmented film to imprint characters on the film. The characters of the printed matter are on a cliche of the hot printer. The TP station 2*a* is preset to obtain the character printing information, such as a prescription, a lot number, or data relating to the production. Furthermore, a print menu incorporated into the TP station 2*a* allows for the setup of various printing parameters, such as bag size (50 cc to 5,000 cc), temperature, speed, and the like.

Figure 2B:
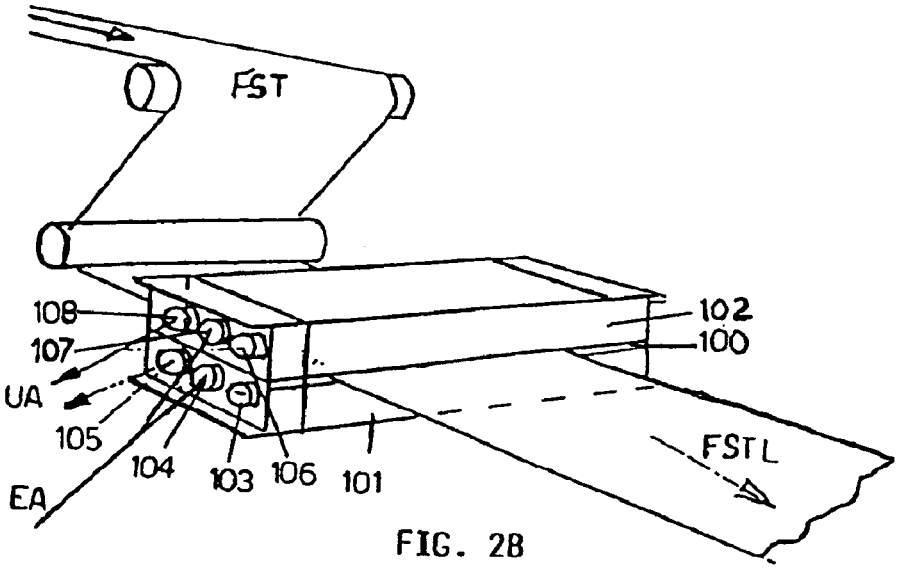
FIG. 2B is a partial perspective view of an embodiment of a dry cleaning means of the present invention.
Figure 2C:
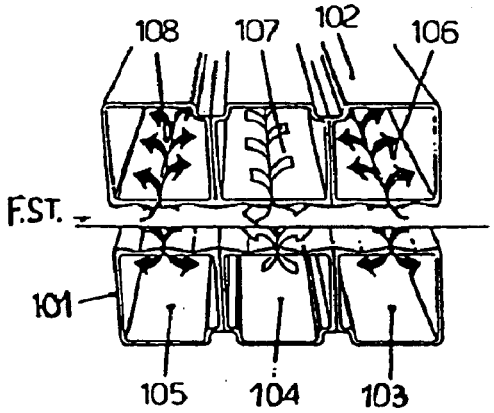
FIG. 2C is a partial perspective view of the embodiment of the dry cleaning means of FIG. 2B.

Block 3 of FIG. 1 represents a washing station phase that comprises a single dry washing stage. The film entering the dry washing stage is labeled FST and the film exiting the dry washing stage is labeled FSTL, as shown in FIG. 1. The dry washing stage does not allow the film to contact any liquids or supports of the system. A preferred embodiment of the washing stage is represented in FIGS. 2B and 2C. In this embodiment, the washing stage is formed by two superimposed chambers 101 and 102 forming a central slot for the printed film FST to pass therethrough. The printed film FST is suspended and subjected to filtered air AF flowing from nozzles 104 and 107. The air flows over the printed film FST and carries away any particles or impurities from the printed film FST. The air flows out through nozzles 103, 105, 106, and 108. The stations represented by blocks 2 and 3 can operate and handle a plurality of film configurations, such as in the case of using two reels B and B' of equal length, or using a single reel B" having a width n times greater than B or B'.

Block 4 of FIG. 1 represents a station comprising four substeps for handling the printed and dry washed film FSTL. The four substeps comprise accumulation 4*b*, gimballing alignment 4*d*, folding 4*e*, and towing 4*f*. Compared to prior art systems, a drying phase is not needed because dry washing is utilized. Furthermore, a sterilization step that utilizes ultraviolet radiation has also been eliminated.

Referring to FIG. 2, the printed and dry washed film FSTL is first aligned by alignment rollers 4*b*. First and second folding rollers 4*e* and 4*e*' facilitate a folding prism PR therebetween for folding the printed and dry washed film FSTL. A towing roller 4*f* cooperates with the second folding roller 4*e*' to complete the handling station.

Figure 4:
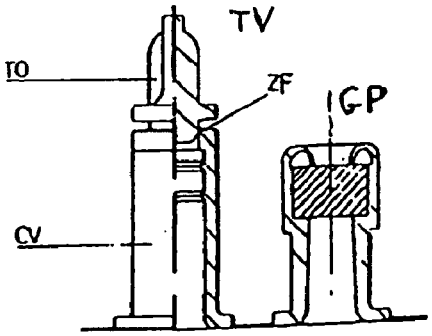
FIG. 4 is an elevational view, partially in section, of a first embodiment of a two-valve structure of a bag manufactured according to the method of the present invention.
Figure 3:
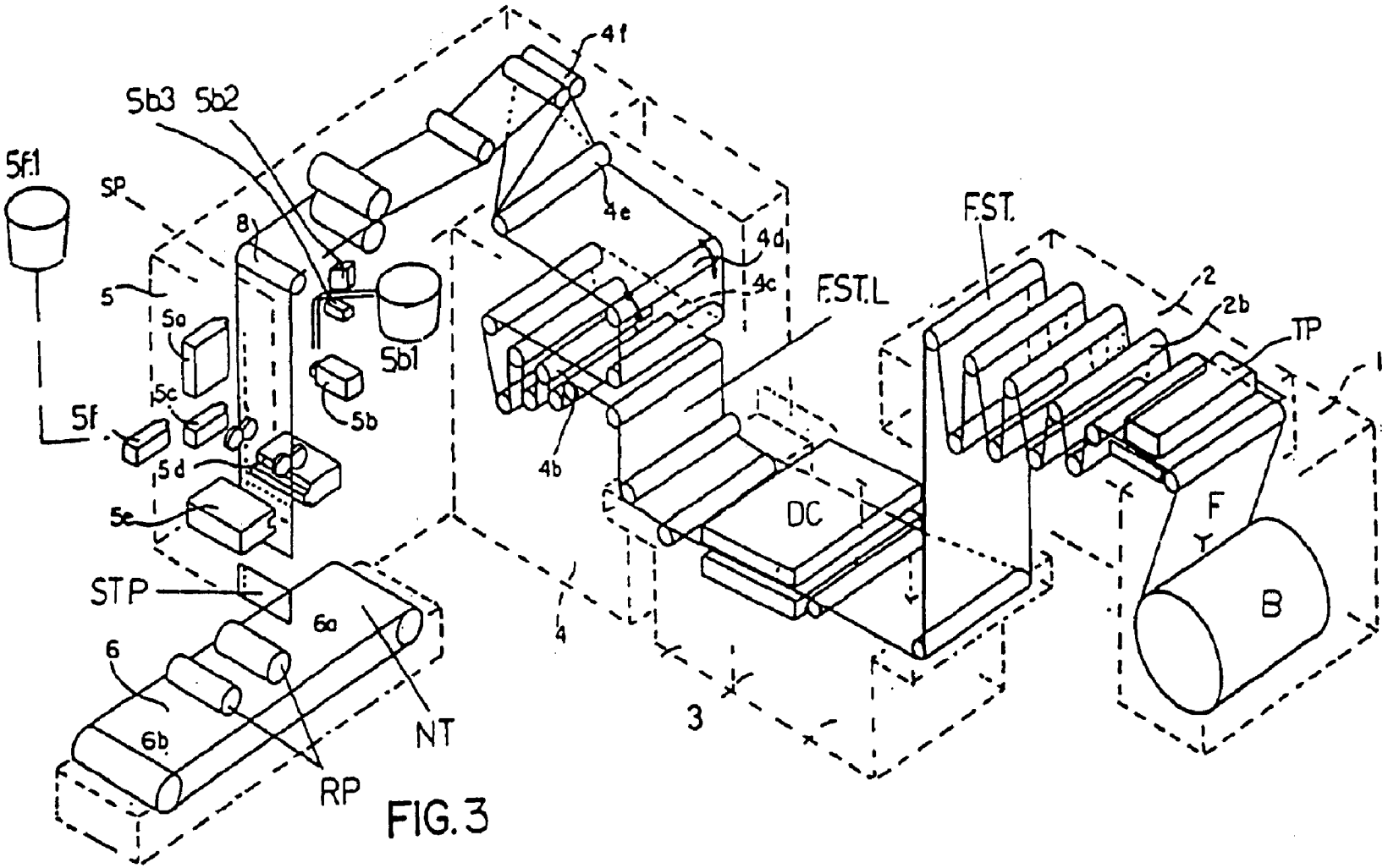
FIG. 3 is a perspective view of a schematic representation of a preferred embodiment of the system of FIG. 1.
Figure 5:
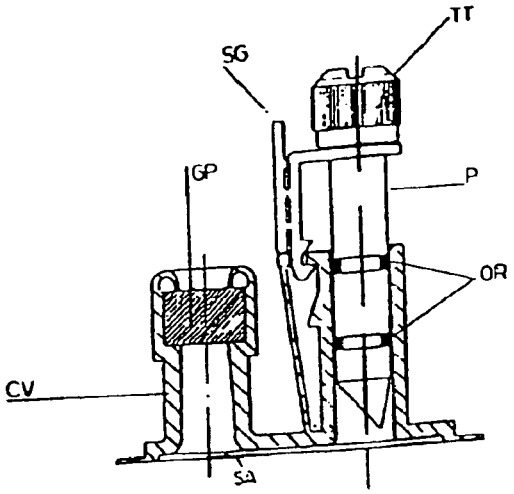
FIG. 5 is an elevational view, partially in section, of a second embodiment of a two-valve structure of a bag manufactured according to the method of the present invention.
Figure 6:
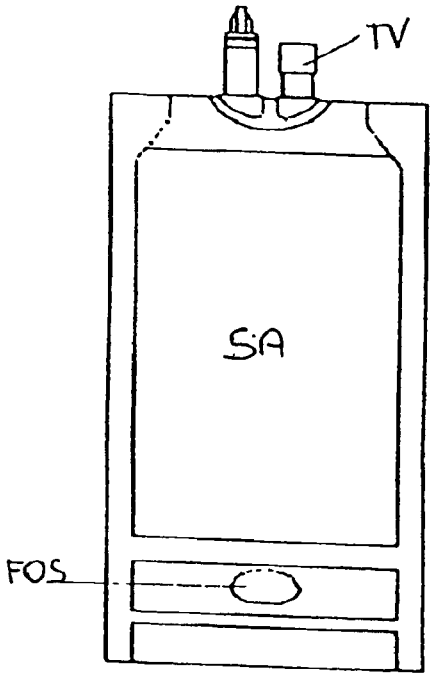
FIG. 6 is a top plan view of a bag manufactured according to the method of the present invention and incorporating the valve assembly of FIG. 4.
Figure 7:
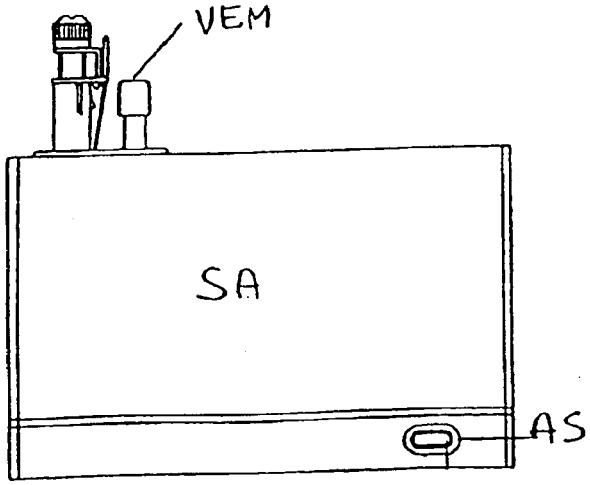
FIG. 7 is a top plan view of a bag manufactured according to the method of the present invention and incorporating the valve assembly of FIG. 5.

Block 5 of FIG. 1 represents the bag formation step of the manufacturing process. The bag formation step involves vertical welding of the film as well as the attachment of one or more valves. The bag formation step comprises a vertical welding substation 5*a* and a valve attachment substation 5*b*. The bag is formed and the valves are attached by welding. FIGS. 4 and 5 show two valve structures that can be attached to the bag. Such valves are disclosed in U.S. Pat. No. 4,467,003.

In more detail, the bag formation step of block 5 comprises a vibrator 5*b*1 for feeding the valves during the assembly process, a humidification means, such as a spray wetter 5*b*2, for wetting the valve cavities, a detection and controlling means 5*b*3 for the spray wetter, a suspension hole forming means 5*c* that forms a suspension hole in the bag, and a suspension ring application means 5*f* that applies suspension rings to the suspension hole of the bag. A vibrator 5*f*1 is also included for feeding the suspension rings during the assembly process.

Figure 12:
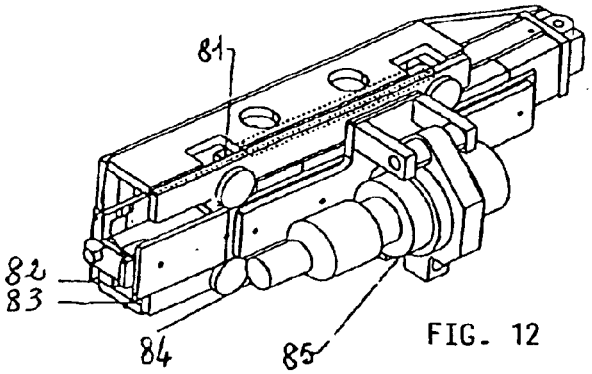
FIG. 12 is a perspective view of a valve welding station of the system of the present invention.
Figure 11:
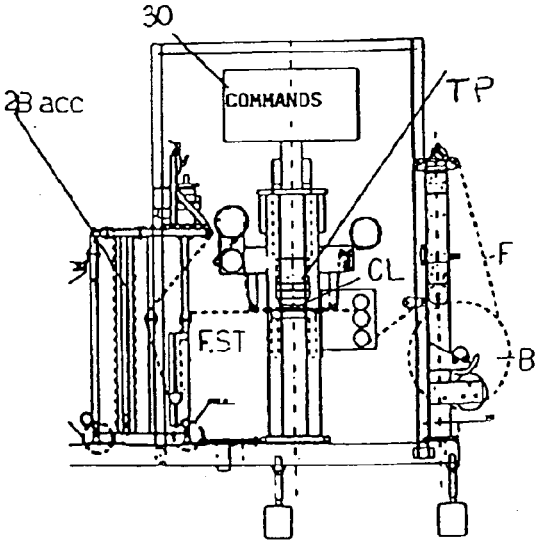
FIG. 11 is an elevational side view of an embodiment of a total print station of the system of the present invention.

In a preferred embodiment of the invention, the valve welder is an ultrasound welder with open ring control of position and approach speed. FIG. 12 shows the valve attachment station 5*b* as a welding and molding station. The valve attachment station 5*b* comprises a position transducer 81, a cylinder 82, a slide 83, a sonotrode 84 (welding head) and a transducer 85. The system allows for continuous checking of the position and speed of the sonotrode 84 at substation 5*b* with respect to an anvil l (not shown). With a PID (Proportional Integral Derivative) algorithm sampled to a thousandth of a second, the speed and acceleration/deceleration of the sonotrode/anvil impact was optimized. This allows the welding operation and the resulting weld to be optimized with respect to the bag material utilized.

Referring to FIG. 1, station SP fills the bag with the proper dose, or volume, of the liquid RIEM. The station SP is a precise, substantially automatic station that includes electropneumatic valves 60 and 62 that are fed by line 61. A processing switchboard 63 allows for control of the valves 60 and 62. The valves 60 and 62 provide a double electropnuematic thrust and permit opening and closing of the valves 60 and 62 in a time of 3 to 5 thousandths of a second, which provides a dosage tolerance of +/−1 cc per dosage quantity.

Figure 9:
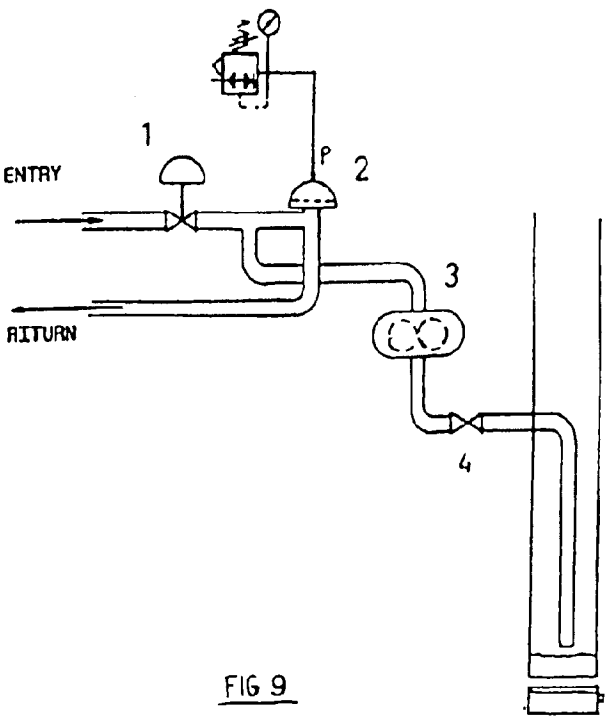
FIG. 9 is a schematic view of a high precision liquid dosing means for filling the bags manufactured according to the method of the present invention.
Figure 10:
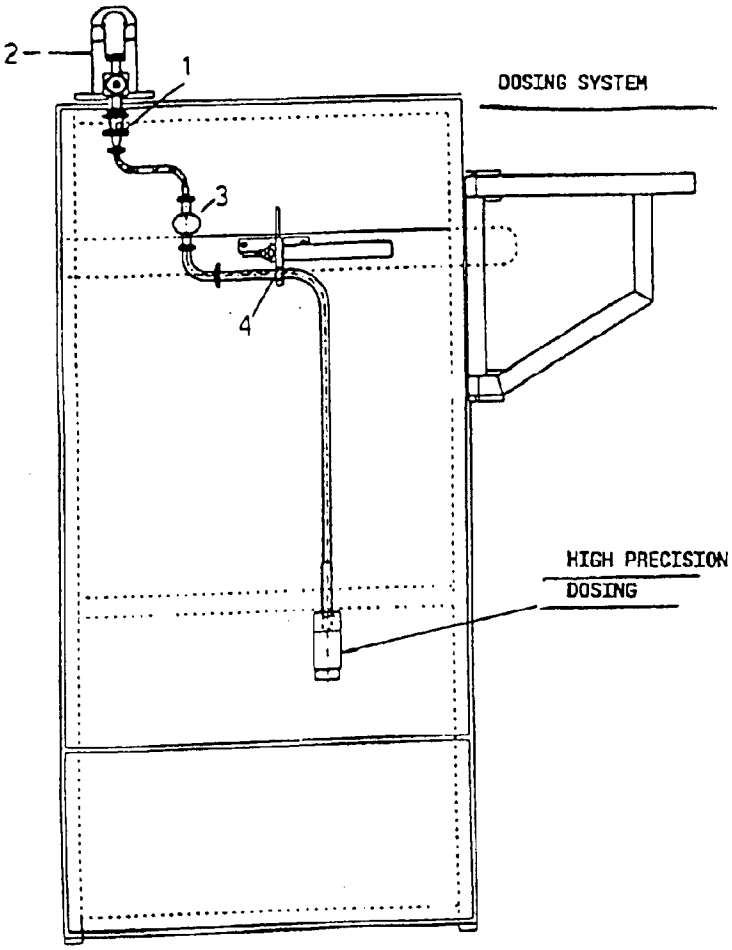
FIG. 10 is a schematic view of a filling portion of an actuating machine of the system of the present invention that incorporates the dosing means of FIG. 9.

In a preferred embodiment, the valves 60 and 62 are controlled by pulses generated by a lobed flowmeter that utilizes a Hall effect. FIGS. 9 and 10 depict the station SP in more detail.

Figure 13:
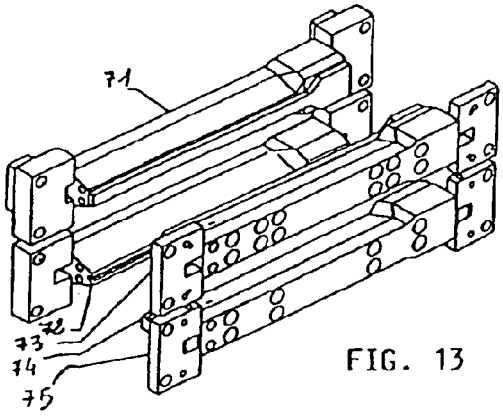
FIG. 13 is a perspective view of a final welding and molding block of the system of the present invention.

FIG. 13 depicts a mechanism for shaping the bags contemporaneously with horizontal welding via movable bars 71 and 73. The bars 71 and 73 are heated by electric heating elements and allows the bars 71 and 73 to compress and thermoform the bags without the formation of ears. The mechanism of FIG. 13 also includes a non-heated cutting edge 72 and a cutting edge support 74.

A PID type algorithm is used to control the temperature of the bars 71 and 73. For example, the temperature can be controlled on twelve selected points on the bars 71 and 73. The non-heated bars 72 and 74 provide immediate cooling of the thermoformed area of the bag. The bars 72 and 74 also cut the bags to the desired dimension.

Figure 8:
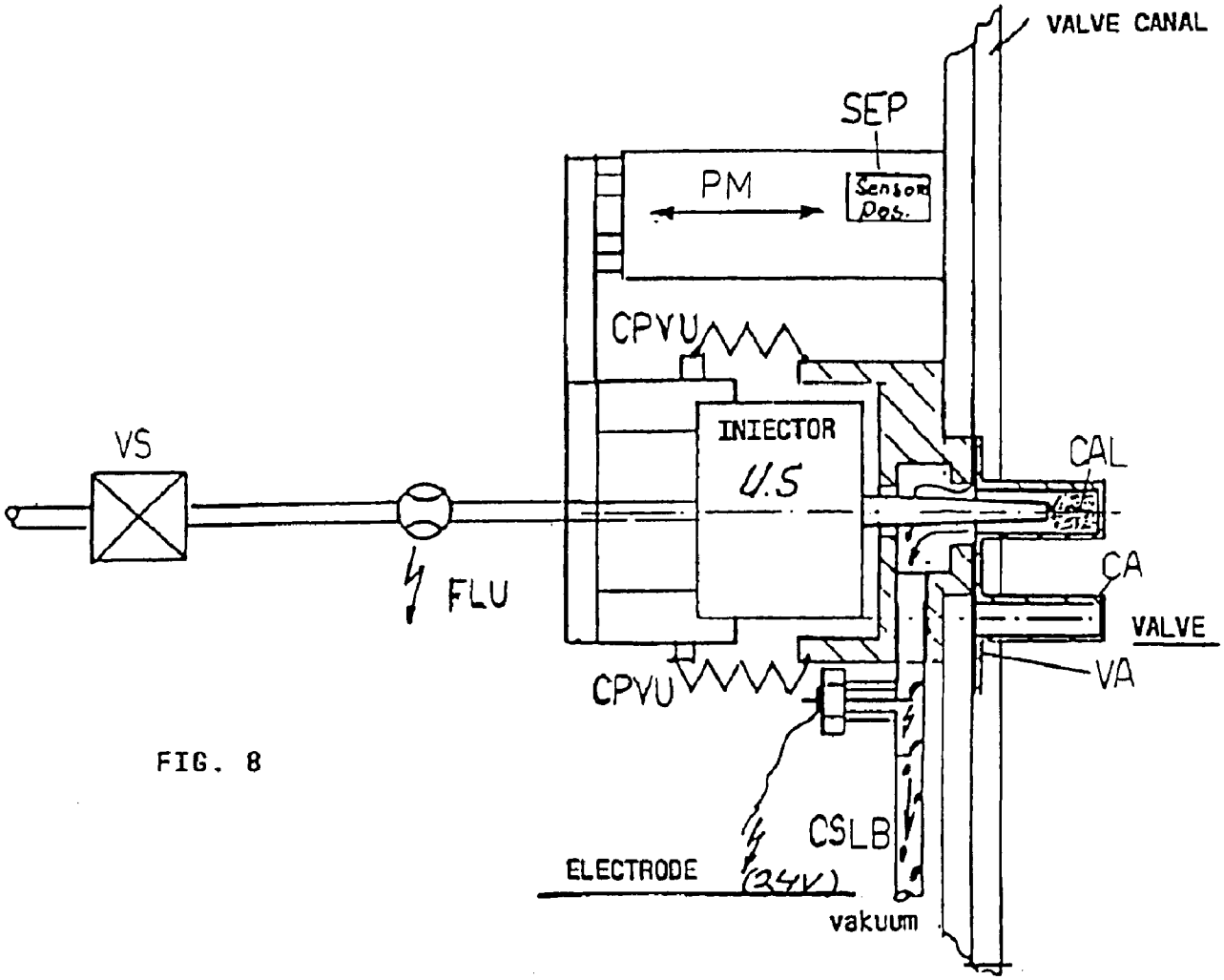
FIG. 8 is a schematic view in partial cross-section of a humidification means for humidifying the valves of the bags manufactured according to the method of the present invention.

The valve cavities depicted in FIGS. 4 and 5 can be humidified, or wetted, by use of the mechanism depicted in FIG. 8. The mechanism includes a valve VS, a fluxstate FLU, a nebulization nozzle US, a piston PM to move the nozzle US, a sensor SEP that controls the piston PM, a bridging circuit for the measurement of the electrical conductivity in the wetted cavity that provides humidification control, and a discharge channel for the wetting liquid CSLB. The nozzle US includes a lance for penetration into the valve cavities. The wetting liquid CSLB is preferably distilled water, a physiological solution, or hydrogen peroxide. The wetting liquid is used to sanitize and detect electric conductability in the cavities.

The system of the present invention can be used to weld one or more valves onto the same bag or even welding valves only on a particular series of bags, e.g., even or odd numbered bags. The film F in FIG. 1 used to form the bags can be multilayer, comprising polymers or copolymers that include laminated olefins, amides, esters, or the like, as disclosed in U.S. Pat. No. 4,326,574. Preferably, the film F is coextruded, such as disclosed in Applicant's European Patent Application Number 0658421 and International Patent Number WO 95/16565.

Optimal results have been obtained with coextruded film based on two external layers of ethylene and propylene copolymers or of two chemically diverse layers, such as polyethylene/polypropylene. The adhesion of the two layers is ensured by an appropriate coextruded binding, which is also a polyolefin. By choosing the appropriate composition of the external layers, the binding and the adhesion of the layers can be optimized with respect to weld temperatures and weld resistance during manufacturing. Various properties of the bag material may also be optimized, such as strength of the bag and bag weld, transparency, sterilizability, etc. The coextruded films can also have additional layers that are themselves coextruded or laminated to the coextruded films.

While the specific embodiments have been illustrated and described, numerous modifications come to mind without significantly departing from the spirit of the invention and the scope of protection is only limited by the scope of the accompanying claims.

What is claimed is:

1. A method of forming flexible plastic containers and filling with infusion-type solutions, the method comprising the steps of:

printing of a film wound off a supply reel;

directing a gas from a gas applicator toward and across a dry surface of the film to remove impurities therefrom;

carrying the impurities away from the dry film surface with a nozzle juxtaposed the gas applicator to dry clean the film without contact with a liquid or system supports;

aligning the film for folding thereof;

hot-bar longitudinal welding of the folded film to create a bag;

sterilizing a cavity of a valve by humidifying the cavity without exposing the cavity to ultraviolet radiation;

welding the valve to the film using a control algorithm to control the speed and position of a welding head during the welding head's approach to an anvil;

shaping the bag using hot tools controlled by an algorithm; and supplying a high precision dosage of a filling liquid into the bag.

2. The method of claim 1, wherein the hot-bar longitudinal welding of the film creates a vertical seal.

3. The method of claim 1, wherein the cavities of the valve are subjected to humidification outside the bag and without contact with the filling solution by a means to dose the liquid as a function of a volume of the cavity.

4. The method of claim 3, wherein the humidification step is effected by a humidification apparatus located downstream from a vibrator associated with the step of feeding the valves for welding onto the bag, and wherein a humidification control that controls the humidification of the cavities of the valves is located downstream from the humidification apparatus.

5. The method of claim 3, wherein a liquid used for humidification is selected from the group consisting of distilled water, physiological solutions and hydrogen peroxide.

6. The method of claim 4, wherein the humidification apparatus includes a source of sterile liquid, a dosing valve, a fluxstate, and a nozzle that is moved by a piston controlled by a sensor, the nozzle including a lance for penetration into the valve cavities, the discharged sterile liquid being detected by a circuit with electric bridging.

7. The method of claim 5, wherein hydrogen peroxide is used to sanitize and detect electric conductability in the cavities.

8. The method of claim 1, wherein the printing of the film wound off the supply reel is facilitated by a hot printer having a hot press, a pigmented film, and a film impression member that impresses the film wound off the supply reel.

9. The method of claim 1, wherein the film is dry cleaned with purified air.

10. The method of claim 1, further including the step of welding a suspension ring to the bag.

11. The method of claim 1, further including the step of forming a suspension hole in the bag.

12. The method claim 1, further including the step of accumulating the film prior to aligning the film.

13. The method of claim 1, wherein the filling liquid is precisely dosed in a station that includes an inlet portion having a contribution regulation valve, a constant pressured valve, and a lobed flowmeter having a Hall effect that controls the dosing of the filling liquid.

14. The method of claim 1, further including the step of washing a portion of the film with the filling liquid prior to the bag being welded longitudinally.

15. The method of claim 1, further including the step of transverse welding the film to form the bag.

16. The method of claim 15, wherein the transverse welding is carried out with mobile bars heated by electric resistances of high output having a plurality of temperature control points and cooling effected by mobile cold bars that cool the welding.

17. The method of claim 16, wherein the cold bars contain means for cutting and separating the bags.

18. The system of claim 16, wherein the valve welding is accomplished with a position transducer, a cylinder, a slide, a sonotrode and a piezoelectric transducer.

19. A method of forming flexible plastic containers and filling with infusion-type solutions, the method comprising the steps of:

printing of a film wound off a supplying reel;

directing a gas from a gas applicator toward and across a dry surface of the film to remove impurities therefrom;

carrying the impurities away from the dry film surface and the gas out through a nozzle juxtaposed the gas applicator to dry clean the film without contact with a liquid or system supports;

accumulating the film;

aligning the film for folding thereof;

washing the film with the filling liquid;

hot-bar longitudinal welding and transverse welding of the folded film to create a bag;

sterilizing a cavity of a valve by humidifying the cavity without exposing the cavity to ultraviolet radiation;

welding the valve to the film using a control algorithm to control the speed and position of a welding head during the welding head's approach to an anvil;

shaping the bag using hot tools controlled by an algorithm;

forming a suspension hole in the bag; and supplying a high precision dosage of a filling liquid into the bag.

20. The method of claim 13, wherein the dry cleaning step occurs prior to sterilization.

21. The method of claim 1, wherein the dry cleaning step further comprises suspending the printed film between gas application chambers.

22. The method of claim 1, wherein the dry cleaning step further comprises applying the gas to the printed film through a first nozzle and removing the gas from the printed film through nozzles prior to and after the first nozzle in a film travel direction.

23. The method of claim 1, wherein the step of sterilizing a cavity of a valve by humidifying the cavity further comprises controlling humidification in the valve cavity by measuring electrical conductivity in the valve cavity.

* * * * *